US006736068B1

(12) United States Patent
Dumenko et al.

(10) Patent No.: US 6,736,068 B1
(45) Date of Patent: May 18, 2004

(54) DETONATOR

(75) Inventors: Viktor Dumenko, Nora (SE); Ulf Borgström, Karlskoga (SE); Roger Holmberg, Nora (SE)

(73) Assignee: Dyno Nobel Sweden AB, Nora (SE)

( * ) Notice: Subject to any disclaimer, the term of this patent is extended or adjusted under 35 U.S.C. 154(b) by 14 days.

(21) Appl. No.: 10/070,294

(22) PCT Filed: Aug. 31, 2000

(86) PCT No.: PCT/SE00/01676

§ 371 (c)(1),
(2), (4) Date: Jun. 13, 2002

(87) PCT Pub. No.: WO01/18482

PCT Pub. Date: Mar. 15, 2001

(30) Foreign Application Priority Data

Sep. 6, 1999 (SE) ..... 9903139

(51) Int. Cl.[7] ..... F42C 19/08
(52) U.S. Cl. ..... 102/205; 102/275.11; 102/202.5
(58) Field of Search ..... 102/200, 205, 102/202.5, 202.7, 202.14, 275.6, 275.11

(56) References Cited

U.S. PATENT DOCUMENTS

| | | | | |
|---|---|---|---|---|
| 3,096,714 A | | 7/1963 | Yuill | |
| 3,939,772 A | | 2/1976 | Zebree | |
| 3,978,791 A | * | 9/1976 | Lemley et al. | 102/202.14 |
| 4,335,652 A | * | 6/1982 | Bryan | 102/202.1 |
| 4,429,632 A | * | 2/1984 | Yunan | 102/202.13 |
| 4,727,808 A | * | 3/1988 | Wang et al. | 102/202.5 |
| 4,809,610 A | | 3/1989 | Florin | |
| 5,223,664 A | * | 6/1993 | Rogers | 102/275.1 |
| 5,291,828 A | | 3/1994 | Nerheim et al. | |
| 5,385,098 A | | 1/1995 | Linqvist et al. | |
| 5,945,627 A | | 8/1999 | Arpin et al. | |

FOREIGN PATENT DOCUMENTS

| | | | | |
|---|---|---|---|---|
| EP | 339847 A2 | * | 11/1989 | F42B/3/12 |
| GB | 2056633 A | * | 3/1981 | C06C/7/00 |
| WO | WO 86/01498 A1 | | 3/1986 | |

* cited by examiner

*Primary Examiner*—Michael J. Carone
*Assistant Examiner*—Gabriel Sukman
(74) *Attorney, Agent, or Firm*—Burns, Doane, Swecker & Mathis, L.L.P.

(57) ABSTRACT

The invention relates to an initiating element for use in a detonator to cause a base charge arranged in the detonator, to detonate. The initiating element comprises an ignitable initiating charge which upon ignition generates combustion gases by means of which the base charge is intended to be caused to detonate. The initiating element comprises a compression means which is arranged to be acted upon by said combustion gases to be moved towards the base charge for compression of the same. The invention further relates to a method of igniting a compressed base charge in a detonator, the base charge being further compressed during an initiation phase to increased density. In addition, the invention relates to a detonator provided with a base charge which at a moment of detonation has increased density.

14 Claims, 2 Drawing Sheets

DETONATOR

TECHNICAL FIELD

The present invention generally relates to a detonator as well as to an initiating element and an associated method.

BACKGROUND OF THE INVENTION

Detonators are used either as an explosive per se or to detonate other explosives.

In a typical embodiment, a detonator comprises a shell having a closed end against which a base charge is packed or pressed. In the other end of the shell, an igniting means, such as a pyrotechnical fuse, a NONEL® tube or an electric fuse head, is arranged. Between the igniting means and the base charge, an initiating charge is arranged, which can be ignited by the igniting means. The combustion of the initiating charge initiates the detonation of the base charge.

Explosives are roughly divided into primary explosives and secondary explosives. The primary explosives are characterised in that they are able to develop full detonation out of being heated when present in small quantities in a free state i.e. when unconfined. On the other hand, the secondary explosives need to be confined and require greater quantities or heavy mechanical impact to develop detonation. For security reasons, use of primary explosives is often avoided, and the present invention only relates to detonators which are free from primary explosives. As examples of secondary explosives mention can be made of PETN (pentaerythritoltetranitrate), HMX (cyclotetramethylenetetranitramine), RDX (phlegmatised hexgen, cyclotrimethylenetrinitramine), TNT (trinitrotoluene), Tetryl (trinitrophenylmethylnitramine) and mixtures of one or more of these.

There is a quadratic relation between the detonation speed of an explosive and the shock wave energy which develops at the detonation. In order to obtain the greatest possible explosive effect, a high detonation speed must therefore be provided. This is the case in particular with detonators which are used for detonation of other explosives, since the detonators generally contain only a small amount of secondary explosive, which should thus detonate at the highest possible speed to achieve a maximum explosive effect.

The detonation speed of an explosive increases as the density of the explosive increases. The detonation speed of phlegmatised hexogen (RDX) is, for instance, 8.7 km/s at the density 1.8 g/cm$^3$, whereas it is only 7.6 km/s at the density 1.5 g/cm$^3$, which corresponds to a reduction of the shock wave energy by almost 30%.

Detonators according to prior-art technique are provided with a base charge which is usually pressed to a density of about 1.5–1.55 g/cm$^3$. Even if higher density is desirable, this has not been feasible in practice.

SUMMARY OF THE INVENTION

The main object of the invention is to provide a detonator which, given a certain amount of explosive in the base charge, yields higher shock wave energy than allowed by prior-art technique.

A more concrete object of the invention is to provide further increased density in a base charge pressed into a detonator, thereby to provide an increased detonation speed, and thus enhanced explosive effect, of the detonation charge.

Another object of the invention is to provide an initiating element for use in a detonator, said initiating element allowing further increased density to be imparted to a base charge pressed into the detonator, said density being maintained until the base charge is caused to detonate.

These objects are achieved by means of a method and a detonator or an initiating element according to the appended claims.

Thus the invention is based on the knowledge that a detonator can exhibit enhanced explosive effect given a certain amount of explosive in the base charge if increased density has been imparted to this base charge substantially at the moment of detonation. If the base charge is compressed to such a degree that at least some part thereof attains a substantially crystalline state just before, and during, the detonation, a significantly enhanced explosive effect is provided.

According to one aspect of the invention, use is made of the pressure which arises in the combustion of an initiating charge to further increase the density of an already compressed base charge and to maintain the high density until the bass charge is caused to detonate, resulting in an increased detonation speed and thus enhanced explosive effect. Preferably, such high density of the base charge is provided that the latter, at least partially, attains a substantially crystalline state.

According to another aspect of the invention, the combustion gases from an initiating charge are used to heat until ignition and to compress a loosely packed, or unconfined, secondary explosive whose energy is thus increased, which finally results in detonation of this secondary explosive which thus causes a base charge which is compressed to increased density to detonate.

According to yet another aspect of the invention, an initiating element is provided for use in a detonator to cause a compressed base charge which is arranged in the detonator to detonate.

The initiating element according to the invention comprises a compression means which is arranged to be acted upon by combustion gases, which develop in the combustion of an initiating charge, in order to further compress the base charge.

According to the invention, an initiating element is also provided, which allows hot combustion gases from the combustion of the initiating charge to pass into a chamber which is arranged in the initiating element and which is adjacent to a base charge arranged outside the initiating element. In the chamber, a loosely pressed or unconfined secondary explosive is preferably arranged, which is intended to be heated until ignition by the entering combustion gases, whereby said base charge is finally caused to detonate.

The invention also relates to an initiating element which uses the above-mentioned combustion gases to heat and compress the loosely pressed secondary explosive to cause the same to detonate, at the same time as the compressed base charge is exposed to a force, which originates from the burning initiating charge, which force further increases the density of the base charge, at least some part of the base charge attaining a substantially crystalline state. Preferably, the loosely pressed secondary explosive is already heated until ignition when the compression thereof begins to take effect.

According to the invention, a base charge in the detonator, which is compressed when manufacturing a detonator, is thus caused to detonate with the aid of an initiating charge by means of a method in which the pressure which develops in the combustion of the initiating charge is used to further compress the base charge before the detonation thereof.

According to a preferred embodiment of the invention, the initiating element comprises a secondary explosive which is arranged to cause detonation of the base charge in a detonator.

In a particularly preferred embodiment of an initiating element according to the invention, the secondary explosive of the initiating element causes detonation of the base charge by said secondary explosive being heated until ignition and compressed by means of combustion gases which develop in the combustion of an initiating charge arranged in the initiating element.

One embodiment of a detonator according to the invention may thus comprise an initiating element having a chamber which is connected with a base charge, said chamber containing a comparatively loosely pressed or unconfined secondary explosive. During an initiation phase, i.e. in the combustion of an initiating charge, the volume of said chamber is reduced, resulting in a pressure rise in said chamber. At the same time, the combustion of the initiating charge causes further compression of the base charge which thus attains a substantially crystalline or at least very compressed state. The ignition of the base charge is provided by the burning gases in the initiating charge passing into said chamber, whereby the explosive in this chamber is heated until ignition. When the explosive in the chamber has been heated until ignition, the pressure, and thus the energy, in the chamber is increased so that this explosive finally attains detonation, whereby the base charge in caused to detonate.

In preferred embodiments, the pressure rise in said chamber is provided by a positive pressure which is caused by the initiating charge pushing a movably arranged piston into the chamber, so that the volume thereof is reduced. Preferably, the thickness of the piston is greater than 0.15 mm and smaller than 1.0 mm.

The diameter of the above-mentioned chamber is preferably greater than the critical detonation diameter of the explosive which is intended to be placed in the chamber. The critical detonation diameter for PETN (pentaerythritoltetranitrate) is, for instance, about 1 mm. Furthermore, it has been found that the length of the chamber (its axial extension) is advantageously greater than its diameter, but smaller than about ten times its diameter.

Moreover, in preferred embodiments use is made of a suitably piston-shaped compression means to provide said further compression of the base charge, the above-mentioned chamber being arranged as a preferably axial duct in the compression means. It has been found that the diameter of the compression means is advantageously at least 1.1 times greater than the diameter of such a duct. More preferably, it is at least 1.5 times greater and most preferably about two times greater than the diameter of the duct.

The present invention allows manufacture of initiating elements having a total length of 9–10 mm, which is comparable with the primary explosive charge in detonators according to prior-art technique, in which the length of the column of primary explosive in the initiating charge is typically about 6–7 mm.

BRIEF DESCRIPTION OF THE DRAWINGS

The various features and functions of the invention will be apparent from the description below of a number of preferred embodiments. In the description, reference is made to the accompanying drawings, in which FIG. 1 schematically shows a cross-section of a detonator according to the invention, FIG. 2 schematically shows a cross-section of a detonator according to the invention during the initiation phase and FIGS. 3–9 schematically show various embodiments of initiating elements according to the invention.

It is to be noted that parts or portions having the same or a similar appearance or function in the Figures are provided with the same reference numerals.

DESCRIPTION OF THE PREFERRED EMBODIMENTS

Figure 1:
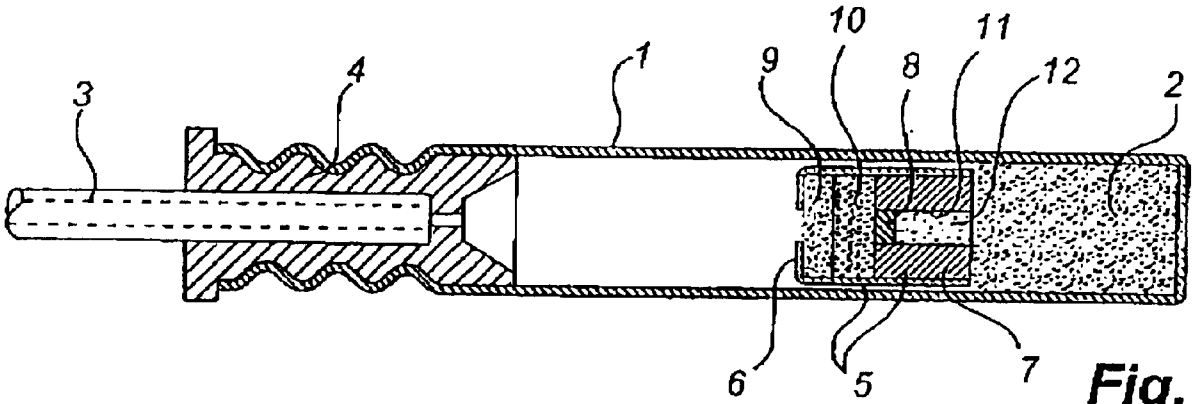

With reference to FIG. 1, a preferred embodiment of a detonator according to the invention will now be described in more detail. According to this embodiment of the invention, a detonator comprises a shell 1 which has an open end and a closed end, the outer diameter of the shell being about 6.5 mm. A base charge 2 of a secondary explosive is pressed against the closed end of the shell (to a density of about 1.5–1.55 g/cm$^3$) and at the open end of the shell an igniting means 3, in this case a NONEL® tube, is arranged by means of a seal 4. Inside the shell 1, adjacent to said base charge 2, an initiating element 5 is arranged which transfers an igniting impulse from the NONEL® tube 3 to the base charge 2 to cause detonation thereof. The initiating element is basically cylindrical, one of its ends facing the NONEL® tube 3 and the other end facing the base charge 2. At the end of the initiating element 5 facing the NONEL® tube 3, an opening 6 is made. In the initiating element 5, adjacent to said opening 6, a pyrotechnical charge 9 is arranged in series with a secondary explosive 10. The pyrotechnical charge and the secondary explosive together form an initiating charge. The pyrotechnical charge is described in more detail below. The secondary explosive 10 is arranged adjacent to an initiator which comprises a first and a second piston 7 and 8, respectively. One end face of the first piston 7 rests on the compressed base charge 2 and can therefore hardly move, this first piston therefore being referred to as static. It will, however, be understood that the static piston 7 in most cases will move a short distance δ towards the base charge during the initiation phase. In this piston 7, a central cylindrical duct 11 is formed, which extends along the central longitudinal axis of the static piston 7 and is at one end in connection with the compressed base charge 2 and at the other end limited by a movably arranged second piston 8. Since the second piston 8 can move considerably more than he first, static piston, this piston 8 is called a dynamic piston. The duct 11 contains a secondary explosive 12, which in this case is PETN (pentaerythritoltetranitrate), HMX (cyclotetramethylenetetranitramine), RDX (phlegmatised hexogen, cyclotrimethylenetrinitramine) or a mixture of one or more of these secondary explosives in an unconfined or loosely pressed state (having a density of about 0.8–1.4 g/cm$^3$). The duct 11 thus contains some amount of air (or possibly some other gas mixture).

A typical detonator has an outer diameter of 7.5 mm and a length of about 65 mm. The shell of the detonator has a wall thickness of about 0.8 mm and the casing of the cylindrical initiating element has an outer diameter of about 5.5 mm and a wall thickness of about 0.4 mm. The cylindrical, static piston arranged in the initiating element has an outer diameter of about 5.1 mm and a length of about 5 mm. The duct which is made in the static piston is also substantially cylindrical and has a diameter of about 3 mm and a length of about 5 mm. The initiating element thus has a static piston with an outer diameter which is about 1.7 times greater than the diameter of the duct which is formed in the static piston. The duct thus constitutes about 35% of the total cross-sectional area of the static piston. In this case, the dynamic piston 8 has a thickness of about 0.4 mm and a diameter which substantially corresponds to the diameter of the duct. The total length of the initiating element is about 10 mm.

Figure 2:
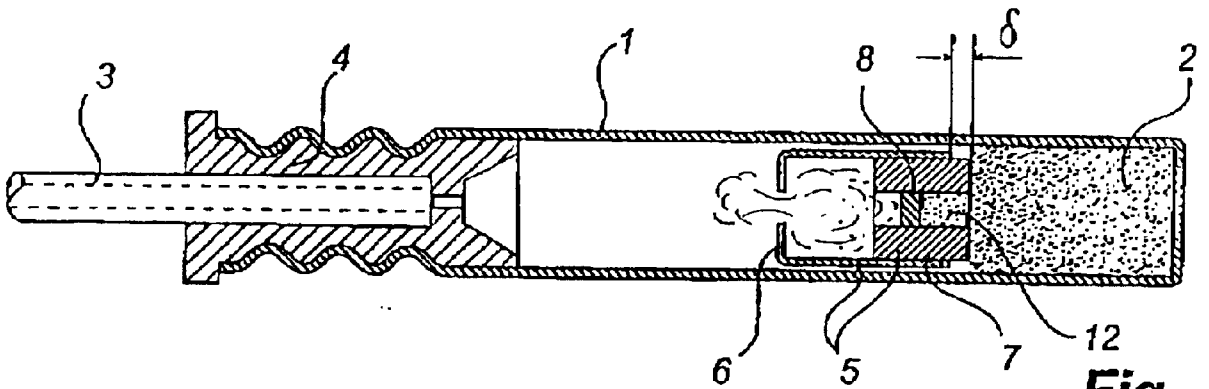

With reference to FIG. 2, a process of ignition of a detonator according to the invention will now be described. When an igniting impulse is emitted by the igniting means 3, which in this case is a NONEL® tube, the pyrotechnial charge 9 is ignited, after which the secondary explosive 10 is ignited with a short induction period. The combustion of the initiating charge creates a high pressure acting on the pistons 7 and 8. The static piston 7 then exerts a heavy pressure on the base charge 2, said base charge attaining a substantially crystalline or at least a very compressed state with high density at least adjacent to the piston. The so-called static piston will then have moved a short distance δ towards the base charge, even if it remains essentially static. The construction of the initiator is such that the combustion gases of the initiating charge penetrate into the duct 11 past the dynamic piston 8, resulting in the explosive 12 in the duct being heated to ignition. The piston 8 is pressed into the duct 11 of the static piston, which leads to a pressure rise in the duct. The dynamic piston 8 is prevented, due to friction against the walls of the duct and/or its mass, i.e. its inertia, from moving as rapidly as the combustion gases and therefore the explosive 12 in the duct 11 is heated to ignition already before the pressure in the duct has risen appreciably. The energy in the duct increases as the temperature and the pressure in the duct 11 increase, and when the energy has attained a certain value the secondary explosive 12 in the duct 11 detonates substantially instantaneously in the entire duct, owing to the fact that the secondary explosive is loosely pressed and thus attains a critical energy substantially at the same time in the entire duct. This ignition process yields a comparatively rapid detonation, which propagates to the base charge 2 which due to its hard compression is subject to a very rapid detonation process.

The above-mentioned ignition process allows the base charge to be in a substantially crystalline state, i.e. have very high density, at the moment of detonation. By selecting a suitable mass and size of the pistons and by selecting suitable dimensions of the duct 11 and suitable density of the explosive 12 arranged therein, a detonation having the highest possible detonation speed can be ensured, for every given explosive, in the base charge of the detonator.

The one skilled in the art will find these suitable selections by tests and trial explosions in conventional manner.

It goes without saying that even if FIGS. 1 and 2 show a detonator in which the igniting means 3 is a NONEL® tube, other igniting means, such as an electric fuse head, may also be used.

FIGS. 3–9 show examples of various embodiments of initiating elements 5 according to the invention. The casing of the initiating elements 5 can be made of practically any material, although use is preferably made of a strong material, such as steel, bronze or brass. With a strong material, the walls of the casing can be thin, thereby allowing the initiator to have a diameter which almost equals the inner diameter of the shell 1 and thus also the diameter of the base charge 2, whereby a compressing effect is provided across a large part of the cross-sectional surface of the base charge 2 during the initiation phase.

The piston system 7,8,13–17 and 19 of the initiating element may comprise a plurality of pistons or may initially even be formed as a unit. However, during the initiation phase, there is or arises at least one static piston which increases the compression in the base charge and at least one dynamic piston which ensures the compression of the loosely packed explosive 12 in the chamber 11. In the cases where the piston system is formed as a unit, it is important that a dynamic piston should be separated from the unit during the initiation phase (e. g. by means of the pressure from the combustion of the initiating charge) which dynamic piston thus becomes movable in the duct of the static piston. The material in the pistons will vary from case to case; it has, however, been found that the material advantageously has a modulus of elasticity which is substantially the same as or greater than the modulus of elasticity of the compressed base charge.

In some preferred embodiments, the static piston 7 has an outer shape which is somewhat conical, the narrow end facing the initiating charge, and therefore it easily comes off the casing of the initiating element during the initiation phase, for instance, by the casing of the initiating element expanding slightly under the pressure. At the same time, a conical shape makes it easier to press the static piston 7 into the casing of the initiating element. As soon as the static piston is released from the inner wall of the casing of the initiating element, use is made of a greater amount of the pressing force to compress the base charge.

Figure 3:
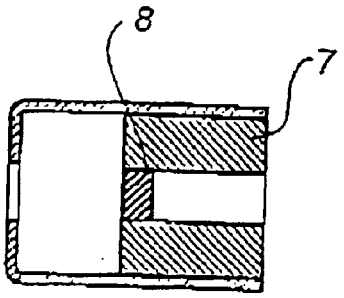

In FIG. 3, the same kind of initiating element is shown as that used in the detonator shown in FIG. 1. In this case, the dynamic piston 8 and the static piston 7 are separate units. The cross-section of the dynamic piston, which in this case is circular, is substantially complementary to the cross-section of the duct 11 which is made in the static piston. The duct 11 has a diameter of 3 mm and a length of 5 mm. The outer diameter of the static piston 7 is about 1.7 times greater than the diameter of the dynamic piston 8 (and thus also about 1.7 times greater than the diameter of the duct 11).

Figure 4:
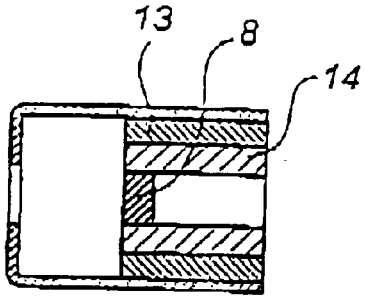
Figure 5:
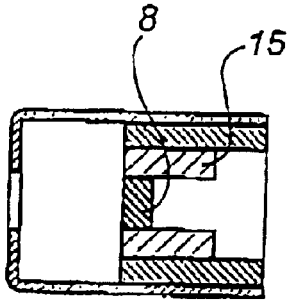

FIG. 4 shows an initiating element which comprises two static pistons 13, 14, whereas FIG. 5 shows an initiating element in which the piston system instead his two dynamic pistons 8, 15.

Figure 6:
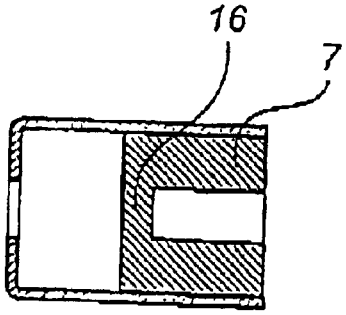

FIG. 6 shows an initiating element in which the piston system initially consists of a unit 7, 16. During the initiation phase, the pressure caused by the combustion of the initiating charge will result in the separation of a portion 16 from the unit, which portion will constitute the dynamic piston, in conformity with the dynamic piston 8 shown in FIG. 3.

Figure 7:
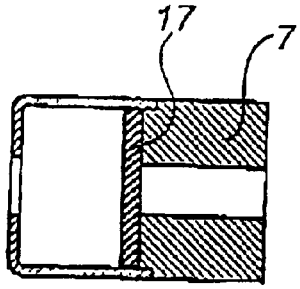
Figure 8:
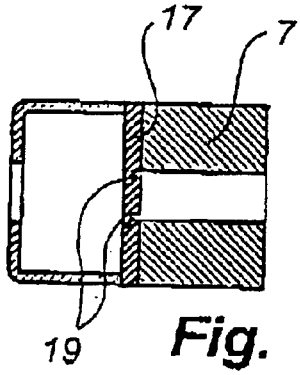

The invention also comprises other arrangements of piston systems. FIG. 7, for instance, shows an initiating element with an initiator which consists of two parts, one part being a static piston in conformity with the static piston 7 shown in FIG. 3 and the other part having the form of a disc 17 which is arranged in front of the static piston 7 and thus covers the duct 11 of the static piston. In conformity with that stated above, part of the disc 17 will be separated during the initiation phase and function as a dynamic piston. To ensure a correct separation of the part in the piston system which is to constitute the dynamic piston, in accordance with the embodiments described with reference to FIGS. 6 and 7, recesses or rupture lines 19 may be provided in the areas in which the separation is meant to take place. This is exemplified in FIG. 8. In FIG. 8, the dimensions of said recesses or rupture lines are selected only for illustrative purposes. In real initiating elements according to the invention, these recesses or rupture lines will, of course, be dimensioned in relation to the rest of the initiating element which differs from that shown in the Figure.

Figure 9:
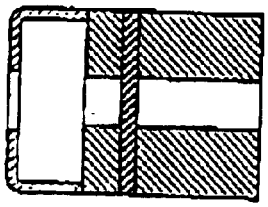

In FIG. 9, yet another embodiment is shown of an initiating element according to the invention. In this case, the static part of the piston system consists of two piston having the same outer diameter and the same diameter of the duct 11. Between these piston parts, a disc is arranged from which a dynamic piston is separated in the above-described manner during the initiation phase.

The initiator can be arranged entirely inside the casing of the initiating element 5 (such as shown in FIGS. 3–6), partly inside the casing (FIG. 7) or only rest on (be clamped against) the casing (FIGS. 8, 9).

Preferably, the duct 11 and thus the dynamic piston 8 are circular in cross-section, but the invention is not limited to any particular geometry of the duct. The selection of the geometric design in a certain case is a matter of convenience which is decided by the one skilled in the art and may be freely selected within the scope of the invention and the inventive idea.

DESCRIPTION OF THE INITIATING CHARGE

Preferably, the pyrotechnical charge 9 of the initiating charge has a burning speed which is higher than 5 m/s, more preferably higher than 10 m/s and most preferably higher than 20 m/s. The transition from declaration to detonation in the initiating element should not take more than about 0.5 ms, and therefore the burning speed of the pyrotechnical charge must not be too low. At the same time it is highly desirable that the secondary explosive of the initiating charge should exhibit a substantially plane combustion front, which enables the pistons of the piston system to work synchronously. Furthermore, the induction period of said secondary explosive should be such that the deviation of zero interval detonators does not exceed ±0.1 ms. The function of the initiator according to the present invention depends on the generation of a sufficiently high pressure in the combustion of the initiating charge. In practice, this means that the temperature in the igniting pyrotechnical charge is preferably higher than 2000° C. More preferably the temperature is higher than 2500° C. and most preferably higher than 3300° C. By the high combustion temperature of the pyrotechnical charge, a rapid and reliable ignition of the secondary explosive of the initiating charge is also ensured. Suitable pyrotechnical materials for this purpose are so-called "thermites", which comprise metal powder (e.g. Mg, Al, Ti, Zr) which serve as fuel, and metallic oxides serve as oxidants. For instance, pyrotechnical mixtures, such as (30–40)% Al+(70–60)% $Fe_2O_3$ and (20–40)% Ti+(80–60)% $Bi_2O_3$ may be used, which cause detonation in the base charge within 0.1–0.5 ms. The transition time from deflagration to detonation is thus equivalent to that of detonators using primary explosive.

DESCRIPTION OF TESTS

Below, two different tests will be described, which prove the high detonation speed of detonators according to the present invention.

EXAMPLE 1

A comparison was made between the detonation speeds of three different types of detonators. The detonation speed (i.e. the explosive effect) was compared by means of a generally accepted method in which a detonator is positioned with its end against a lead plate having a thickness of 5 mm, the diameter of the hole which bursts open at the detonation of the detonator being taken as a measure of its explosive effect (detonation speed).

Ten detonators of three different types were fired, the first type being detonators with primary explosive according to prior-art technique; the second type being detonators without any primary explosive according to prior-art technique; and the third type being detonators according to the present invention. All detonators contained an equal amount of explosive, namely 470 mg RDX and 180 mg PETN. The detonators according to prior-art technique, whether with or without primary explosive, yielded substantially the same result. The diameter of the burst-open holes was in the range of 9–10 mm. The detonators according to the present invention had a significantly higher detonation speed and made holes having diameters from 12.0 mm to 12.1 mm.

EXAMPLE 2

A comparison was made between the same three types of detonators as in Example 1. The comparison was made according to a generally accepted method called "Prior". The tests showed that both types of detonators according to prior-art technique corresponded to detonator No. 11, whereas the detonators according to the present invention corresponded to detonator No. 13.5.

The above-described examples show that the present invention provides a significantly increased detonation speed in the detonators compared with detonators according to prior-art technique. Thanks to the use of an initiating element and an igniting method according to the invention, an enhanced explosive effect could be achieved without increasing the amount of explosive in the base charge.

What is claimed is:

1. A method of igniting a compressed base charge in a detonator, the base charge being caused to detonate by means of an initiating charge, wherein the base charge is further compressed to increased density under the action of a pressure from combustion gases which develop from the initiating charge which burns during an initiation phase, the pressure from the combustion gases acting on the base charge by way of a base charge compressing means arranged between the initiating charge and the base charge, the increased density being maintained until the base charge is caused to detonate, wherein a secondary explosive arranged between the initiating charge and the base charge is caused to detonate after the provision of increased density in the base charge, which is ignited by the detonation of said secondary explosive.

2. A method of igniting a compressed base charge in a detonator, the base charge being caused to detonate by means of an initiating charge, wherein the base charge is further compressed to increased density under the action of a pressure from combustion gases which develop from the initiating charge which burns during an initiation phase, the pressure from the combustion gases acting on the base charge by way of a base charge compressing means arranged between the initiating charge and the base charge, said increased density being maintained until the base charge is caused to detonate, wherein the further compression of the base charge which is provided during the initiation phase results in at least some part of the base charge attaining a substantially crystalline state.

3. A method as claimed in claim 1, wherein the secondary explosive is present in a loosely pressed or unconfined state, and the combustion gases of the initiating charge are further used to heat until ignition and to compress the secondary explosive, which is finally caused to detonate.

4. A method as claimed in claim 1, wherein the pressure caused by the combustion of the initiating charge compresses the secondary explosive indirectly by transmission of force via a secondary explosive compressing means arranged between the initiating charge and the secondary explosive.

5. A method as claimed in claim 4, wherein the secondary explosive is first heated until ignition, by combustion gases which develop from the initiating charge flowing into the secondary explosive, and then subject to the compression.

6. An initiating element for use in a detonator to cause a compressed base charge, arranged in the detonator, to detonate, the initiating element comprising an ignitable initiating charge which upon ignition generates combustion gases by means of which the base charge is intended to be caused to detonate, the initiating element comprising a base charge compressing means, which, when the initiating element is positioned in a detonator, is arranged, on the one hand, to abut against the base charge and, on the other, to be acted upon by the combustion gases to be moved towards the base charge for compression of the same, the initiating element further comprising a secondary explosive which is arranged between the initiating charge and the base charge, the secondary explosive being arranged to detonate after provision of increased density in the base charge by the compression and to ignite the base charge by its detonation.

7. An initiating element as claimed in claim 6, wherein the secondary explosive is present in a loosely pressed or unconfined state.

8. An initiating element as claimed in claim 7, wherein means are arranged to heat until ignition and compress the loosely pressed secondary explosive, by the action of the combustion gases, thereby to increase its energy to a level where it is caused to detonate.

9. An initiating element as claimed in claim 8, wherein the loosely pressed secondary explosive is arranged in a duct in, or alternatively around, the base charge compressing means, and a secondary explosive compression means is movably arranged in the duct to cause the compression of the secondary explosive under the action of the pressure from the combustion gages.

10. An initiating element as claimed in claim 9, wherein the length of the duct is greater than its diameter and smaller than ten times its diameter.

11. An initiating element as claimed in claim 9, wherein the base charge compressing means comprises a first piston and the secondary explosive compressing means comprises a movably arranged second piston, the outer diameter of the first piston preferably being between 1.1 and 5.0 times the diameter of the movably arranged second piston.

12. An initiating element as claimed in claim 6, which has a substantially circular cross-section with a diameter which is substantially the same as the inner diameter of a detonator in which the initiating element is intended to be placed.

13. A detonator comprising a compressed base charge of a secondary explosive, wherein at least some part of the base charge is in a substantially crystalline state at the moment of detonation, the detonator comprising means for further comprising the base charge during an initiation phase, at least some part of the base charge thereby attaining the substantially crystalline state.

14. A detonator comprising a compressed base charge of a secondary explosive, th detonator being provided with an initiating element as claimed in claim 6.

* * * * *